United States Patent [19]

Willenbacher

[11] Patent Number: 4,495,877

[45] Date of Patent: Jan. 29, 1985

[54] SEWING MACHINE EQUIPPED FOR PRODUCING SHAPED SEAMS

[75] Inventor: Erich Willenbacher, Kaiserslautern, Fed. Rep. of Germany

[73] Assignee: Pfaff Industriemaschinen GmbH, Fed. Rep. of Germany

[21] Appl. No.: 457,648

[22] Filed: Jan. 13, 1983

[30] Foreign Application Priority Data

May 6, 1982 [DE] Fed. Rep. of Germany ..... 3216993

[51] Int. Cl.[3] ..... D05B 19/00; D05B 27/22

[52] U.S. Cl. ..... 112/121.11; 112/272; 112/275; 112/315

[58] Field of Search ..... 112/121.11, 121.12, 112/275, 277, 315, 262.1, 2, 272, 306, 314

[56] References Cited

U.S. PATENT DOCUMENTS 4,381,719 5/1983 Goldbeck ..... 112/272 X 4,403,558 9/1983 Martell et al. ..... 112/275

4,404,919 9/1983 Martell et al. ..... 112/121.11

*Primary Examiner*—Peter Nerbun

*Attorney, Agent, or Firm*—McGlew and Tuttle

[57] ABSTRACT

A sewing machine for sewing shaped seams comprises equipment for exactly positioning an end stitch. By means of two edge sensing sensors provided one after the other in the feed direction, a pulse generator coupled to the main shaft, and a microprocessor, the difference between the desired feed length of the workpiece and the actual feed length thereof is determined. A microprocessor controls a step motor for adjusting a stitch setting device, the adjustment being a function of the difference between the desired and actual feed lengths of the workpiece and of the angular position of the main shaft at the instant of response of the second sensor. In this way, the length in excess of the last stitch which, without a correction, would extend beyond the predetermined end point, is uniformly distributed among the last stitches of the seam, while at the same time taking into account slippage between the feed dog and the workpiece.

11 Claims, 5 Drawing Figures

1
2
3
4
5
6
7
8
9
10
11
12
13
14
15
16
17
18
19
20
21
22
23
24
25
27
28
29
30
31
32
33
34
35
36
37
38
39
40
41
42
43
44
45
46
47
48
49
50
51
52
53
54
55
56
57
58
59
62
64
69
74
78

26
W
K1
d
α
102
72
E2
82
80
V
68
E1
65
63
101
76
103
104
K2
C

SEWING MACHINE EQUIPPED FOR PRODUCING SHAPED SEAMS

FIELD AND BACKGROUND OF THE INVENTION

The present invention relates in general to sewing machines and in particular to a new and useful sewing machine which is equipped for producing shaped seams.

Sewing machines are known which comprise feed means that are adjustable by a setting device and are equipped for producing shaped seams. The equipment includes a first sensor which is positioned ahead of the needle and senses a trailing edge of a workpiece extending at an angle relative to a leading edge thereof. A pulse generator coupled to the main shaft of the sewing machine and a program controlled switch circuit by which the sewing machine is stopped at a predetermined end point in response to the pulses issuing from the sensor and the pulse generator are provided.

Such a sewing machine for making shaped seams is disclosed in European OS No. 44 648. That machine comprises a positioning motor and equipment for producing corner seams. Corner seams are understood to be a species of the generic group of shaped seams. The equipment comprises a sensor which is provided ahead of the needle and serves the purpose of sensing a trailing workpiece edge extending at an angle to a leading edge, and for starting a counting of stitches formed. The equipment further comprises a microprocessor circuit controlling a positioning motor in order to stop the sewing machine as soon as the needle is stuck in the workpiece at a predetermined corner point.

While sewing a number of identical or similar workpieces, the sewing machine is operated manually during the sewing of the first workpiece, to establish a sewing program, with the number of stitches up to the response of the sensor, and the sewing speed being stored. While sewing the other workpieces, the operation of the sewing machine is controlled automatically by the microprocessor circuit, with the use of the data stored during the programming phase. By sensing the edges of each workpiece and thereby starting the stitch count in the end zone, disturbing factors such as unequal elongation of the workpieces and slippage between the feed mechanism of the sewing machine and the workpieces, are to be eliminated, to keep the accuracy of the seam length within the limits of ± one stitch length.

If a pulse generator coupled to the main shaft of the sewing machine is provided, which permits determination of the angular position of the main shaft or the instant during a stitch formation at which the sensor has responded to the passage of the respective workpiece edge, the microprocessor circuit determines the number of stitches made after the response of the sensor as a function of the difference between the angular position of the main shaft stored during the programming phase, and the angular position thereof measured while sewing the other workpieces. In this way, the seam length accuracy can allegedly be increased to ±0.5 stitch length.

This accuracy, however, cannot be attained if unequal feed conditions are caused with workpieces made of different materials, by unequal surface structure, of unequal thickness, or, with workpieces of identical material, by an unequal direction of the warp and filling threads of the tissue. That is, in such an event, a slip may occur between the feed mechanism of the sewing machine and the respective workpiece, which slip varies from piece to piece and produces the effect that the sewing program established during the manual sewing of the first workpiece no longer exactly fits the following workpieces. But even if, in the most favorable case, an accuracy of ±0.5 stitch length might be attained, a range of tolerance of a whole stitch length would be too large for sewing corners on pieces of garments where importance is attached to a flawless aspect of the seam and thus to an exactly formed end stitch of a seam, equidistantly spaced from either of the workpiece edges.

SUMMARY OF THE INVENTION

The present invention is directed to a sewing machine which is equipped for producing shaped seams, such as one-or two-row corner seams or seams with a locking end stitch exactly spaced from the edge, wherein, to form the last stitch of a seam, the needle pierces the workpiece exactly at a predetermined end point, independently of the actual feed motion of the workpiece.

Due to the provision of a sensing mechanism for determining a difference which is caused, for example, by a slip between the feed mechanism and the workpiece, between the desired feed length of the workpiece and the actual feed length thereof, and due to the provision of setting means associated with the setting device, which means can be controlled through the program-controlled switching circuit to respond to a function of the determined difference between the desired and actual feed lengths and of the angular position of the main shaft at the instant of response of the sensor, the setting mechanism becomes so adjusted for sewing the remaining seam from the instant of the sensor response to the end point, or readjusted with respect to an adjustment for the preceding seam, that the last stitch of the seam comes to terminate exactly at the end point. The length in excess of the last stitch which otherwise would have extended beyond the end point, is uniformly distributed among the other stitches of the seam by reducing the stitch length, while simultaneously taking into account the slip between the feed mechanism and the workpiece, so that a very uniform aspect of the seam is obtained in addition to the exact stitch formation.

The uniformity of the seam may still be improved by providing a reduction of the stitch length if the length in excess of the last stitch is small, or by providing an extension of the stitch length if the length in excess is considerable, in which latter case the number of stitches obtained is one less than would otherwise be obtained.

The angle between the leading edge and the trailing edge of the workpiece, as well as the spacing of the seam from the workpiece edge, may be entered into a memory of the program-controlled switching circuit through a keyboard, for example, of an input unit. While the margin to the seam is normally constant for one and the same workpiece or for a size of workpieces, the edges converging to a corner may form different angles already in one and the same workpiece. It is therefore advisable not to enter these angles in advance as a stored value, but to measure them during the sewing operation on the workpiece and introduce respective data into the program control switching circuit only before the start of the correction process for the last seam portion extending to the end point.

To measure the angle between the leading and trailing edges of the workpiece, a development of the invention provides a second and third sensor ahead of the first one, which additional sensors are spaced from each other in the direction transverse to the feed direction. The measured angle corresponds to the sum of the pulses from the pulse generator registered within the time period between the responses of the two additional sensors.

While sewing two-row corner seams on two-needle sewing machines having individually decoupable needle bars, the end point of the inner seam is approached, in the same way as with a single-row seam, by correspondingly adjusting, through the program controlled switching circuit, the setting means which acts on the setting device. Upon decoupling the inner needle bar, the outer seam is sewn up to the corner point thereof, with the stitch length, and the number of stitches, if applicable, again being determined by the program controlled switching circuit.

If it is desired to have the stitch length of the outer seam of the end portion equal to that of the remaining portion of the seam, the stitch setting device must be pre-adjusted, prior to starting the sewing operation and while taking into account the angle between the workpiece edges and the mutual spacing of the parallel seam rows, so that after decoupling the inner needle bar, a single stitch or an integral multiple thereof, remains to be made in the outer seam, with a substantially unchanged stitch length.

According to another development of the invention, one of the two sensors provided ahead of the first one is used for measuring the actual feed length and forms a part of the sensing device. The magnitude of a slip which might occur between the feed mechanism and the workpiece corresponds to the difference between the sum of pulses of the pulse generator registered within the time period between the response to the two sensors provided one after the other, and the computable number of pulses which would be counted during a slip-free feed of the workpiece while considering the feed amount adjusted in the setting device.

Since a slip between the feed mechanism and the workpiece may be caused, aside from the material, also by the speed of the sewing machine, a further development of the invention provides a fourth sensor by which the trailing edge of the workpiece is sensed and which is provided ahead of the other sensors and starts at the proper time a speed reduction of the sewing machine, so as to obtain a constant low speed during the feed measuring operation.

Accordingly, an object of the present invention is to provide, in a sewing machine having a needle with drive means for driving the needle, feed means for feeding a workpiece having a guiding and a trailing edge extending at an angle relative to each other, a setting device for setting the feed means, and means for producing shaped seams having a first sensor which is positioned ahead of the needle in a feed direction of the workpiece for sensing the trailing edge of the workpiece, a pulse generator coupled to a main shaft of the sewing machine, and a program controlled switching circuit by which the sewing machine is stopped at a predetermined end point in response to pulses issued from the sensor and the pulse generator, the improvement comprising: sensing means for determining an actual feed distance; and setting means associated with the switching circuit and the setting device for controlling the setting device in response to a determined difference between a desired and the actual feed distance and an angular position of the main shaft at an instant of response of the first sensor.

A further object of the invention is to provide such an improvement wherein said sensing means comprises second and third sensors provided ahead of said first sensor in the feed direction of the workpiece, said second and third sensors being spaced apart from each other transverse to the feed direction. Such an improvement including a fourth sensor positioned ahead of said sensing means which senses the trailing edge of the workpiece and is intended to effect a speed reduction of the sewing machine to a lower speed which remains constant during the period of time the actual feed distance is measured.

Another object of the invention is to provide such an improved sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the following, one embodiment of the invention is explained with reference to the drawings in which.

DESCRIPTION OF THE PREFERRED EMBODIMENT

Figure 1:
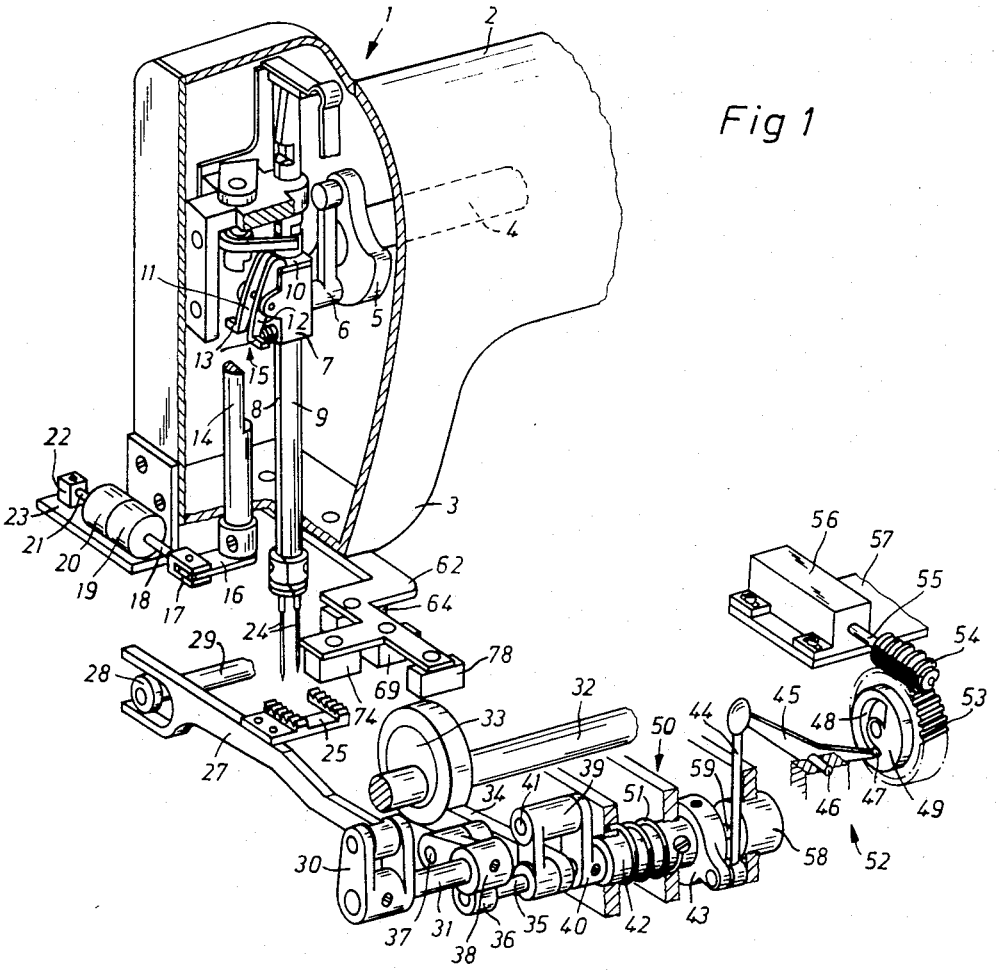
FIG. 1 is a perspective view of the drive mechanism of a two-needle sewing machine, with the needle bars being individually decoupable from the drive.

The sewing machine 1, shown only partly in FIG. 1, comprises an arm 2 and a head 3. A main shaft 4 mounted in arm 2 drives a drive member 7 through a crank 5 and a link 6. A left-hand and right-hand needle bars 8 and 9 each formed with a crossweb 10, are slidably guided in drive member 7. Mounted on drive member 7 are two rocking levers 11, 12 which are formed at their upper ends as drive hooks and, in the shown coupled position, engage over crosswebs 10, so that needle bars 8, 9 are in positive connection with drive member 7. On their lower ends, rocking levers 11, 12 have laterally outwardly bent extensions 13. An actuating shaft 14 is mounted for rotation in head 3. In the zone of rocking levers 11, 12 the cross section of shaft 14 is substantially semicircular. Rocking levers 11, 12 and actuating shaft 14 form parts of a switching mechanism 15 such as disclosed in German utility model No. 19 72 377, first embodiment, FIGS. 1 and 2.

To the lower end of actuating shaft 14, a lever 16 is secured which is connected through a fork head 17 to the piston rod 18 of an air cylinder 19. The housing of air cylinder 10 is secured to the housing of a second air cylinder 20 having its piston rod 21 hinged through a connecting piece 22 to a supporting plate 23 which is fixed to head 3. By means of the series connected air cylinders 19, 20, shaft 14 can be turned into three different switching positions.

Needle bars 8, 9 each carry a needle 24. Needles 24 cooperate with two rotary hooks (not shown) and a feed dog 25. Feed dog 25 is secured to a carrier 27 which is mounted beneath the needle plate 26 (shown in FIG. 5) of the sewing machine. With one of its end, which is forked, carrier 27 engages over an eccentric 28 which is secured to a shaft 29 driven in synchronism with main shaft 4. During each stitch forming cycle, eccentric 28 imparts an upward motion to feed dog 25.

Carrier 27 is connected to a forked crank 30 which is secured to an oscillating shaft 31. To drive shafts 31, an eccentric 33 is secured to a shaft 32 which again is driven in synchronism with main shaft 4, and the eccentric lever 34 of eccentric 33 is hinged to a pin 35. Mounted on pin 35 is a link 36 which is connected, through a pin 37, to a crank 38 which is secured to oscillating shaft 31. Laterally of eccentric lever 34, a link 39 is secured to pin 34, embracing a pin 41, which is carried by a crank 40. The effective length of link 36 equals that of link 39. Consequently, in instances where the two pins 37, 41 are aligned with each other, oscillating shaft 31 remains stationary, in spite of the movement of eccentric lever 34.

To vary the movement of eccentric lever 34 acting on oscillating shaft 31, crank 40 is clamped to a stepped setting shaft 42 carrying a setting crank 43. Crank 43 is connected, through a ball-headed rod 44 to one end of a swing lever 45 pivotable about a fixed axis 46. The free end of swing lever 45 has a ball extension 47 projecting between two side walls of a cam groove 48 of a setting wheel 49 which is mounted for rotation. A torsional spring 51 surrounding setting shaft 42 and secured by one end thereto and by its other end to the housing 50 of sewing machine 1, urges extension 47 of swing lever 45 into permanent contact with one of the side walls of cam groove 48. Component parts 39 to 51 form together a mechanism 52 for setting the magnitude of the feed motion of feed dog 25, with the configuration of the spiral cam groove 48 being such as to allow setting of stitch lengths from 0 to 6 mm.

The circumference of setting wheel 49 is formed with a worm gear 53 meshing with a worm 54. Worm 54 is secured to the shaft 55 of a stepping motor 56 which is adjustably supported on a plate 57 of housing 50.

In alignment with setting shaft 42, a potentiometer 58 is provided on housing 50, having its setting member 59 secured in an axial bore of setting shaft 42. Potentiometer 58 is connected through a line 60 to an input of a microprocessor 61 (FIG. 2) comprising a program controlled switching circuit.

A sensor 64 is secured to a carrier 62 supported by head 3, in a position spaced apart from needle bars 8, 9 and from presser foot 63 (shown diagrammatically in FIGS. 2 and 5), comprising a light emitter and a light receiver. Sensor 64 cooperates with a reflex foil 65 (FIG. 5) which is secured to needle plate 26, and is connected through a line 66 to an input of microprocessor 61. A light beam 67 issuing from the light emitter of sensor 64 falls onto a sensing spot 68 (indicated in FIGS. 3 and 5) and is reflected to the light receiver, provided that the reflex coil 65 is exposed.

Figure 5:
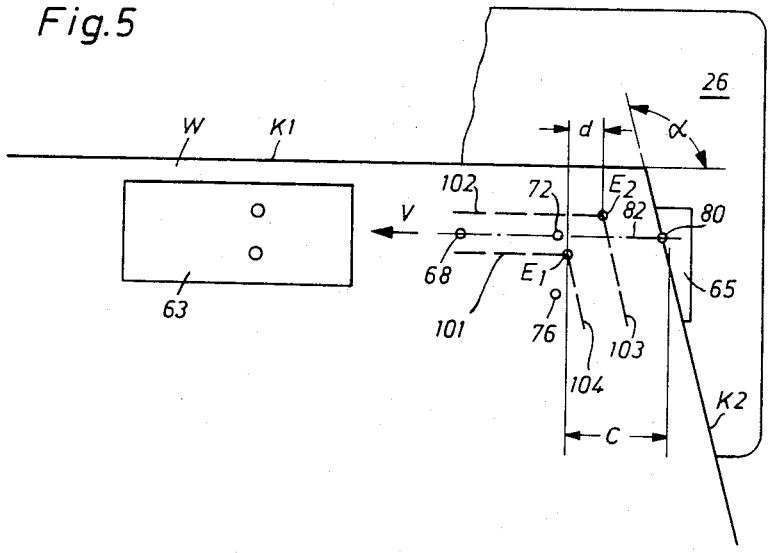
FIG. 5 is a diagrammatical illustration of a corner sewing operation performed with a two-needle sewing machine.

Spaced apart from sensor 64, another sensor 69 of identical design is supported on carrier 62 and serves along with sensor 64, as a sensing device 70 for determining the mangnitude of the feed motion of a workpiece W. Light beam 71 of sensor 69 falls on a sensing spot 72 (FIG. 5). Sensor 69 is connected through a line 73 to an input of microprocessor 61. Spaced laterally apart from sensor 62, a third sensor 74 of identical design is supported on carrier 62, by which, in connection with sensor 69, the angle alpha between edges K1 and K2 of workpiece W are determined. The light beam 75 of sensor 74 falls on a sensing spot 76. Sensor 74 is connected through a line 77 to an input of microprocessor 61.

A fourth sensor 78 of identical design is provided on carrier 62 in a position spaced from sensor 69, to emit a light beam 79 directed at a sensing spot 80. Sensor 78 is connected through a line 81 to an input of microprocessor 61. Sensing spots 68, 72 and 80 are located on a straight line 82 (FIG. 5) extending parallel to the feed direction V.

Figure 2:
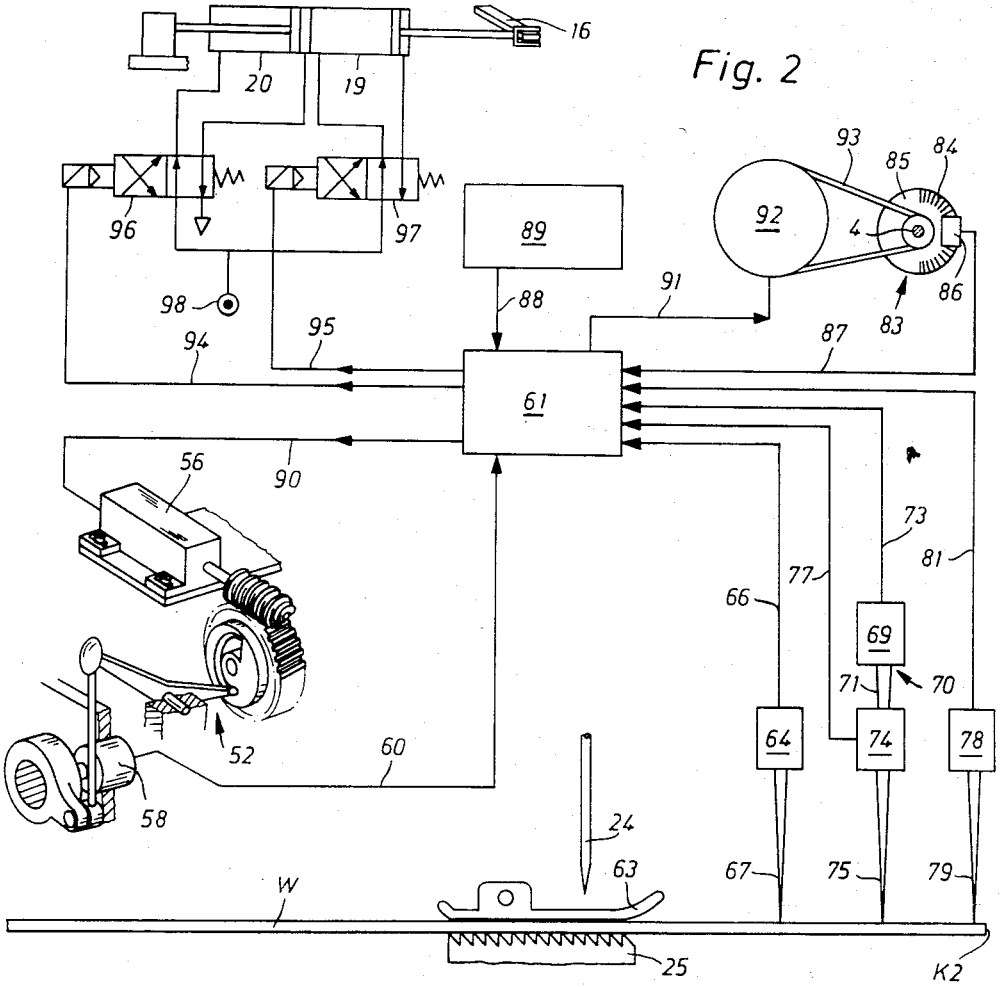
FIG. 2 is a diagrammatical view of the different parts of the equipment for producing shape or shaped seams, and their interconnection and connection with various elements of the sewing machine.

A pulse generator 83 diagrammatically shown in FIG. 2 comprises a pulse disc 85 which is secured to main shaft 4 and provided with a plurality of division marks 84, and a scanner 86 responsive to division marks 84. Pulse generator 83 is connected through a line 87 to an input of microprocessor 61. Division marks 84 are provided only on a portion of pulse disc 85, namely that portion which passes by scanner 86 during the transportation phase of feed dog 25. Therefore, pulse generator 83 delivers plural pulses to microprocessor 61 only during the transportation phase of sewing machine 1 for each stitch to be formed. It may be provided, of course, to employ a pulse generator delivering pulses during the entire time or rotation of main shaft 4, only it must be ensured in such an instance that during the non-transportation phase, of sewing machine 1, the pulses are prevented from being further delivered through line 87 to microprocessor 61. Through a line 88, an input unit 89 diagrammatically shown in FIG. 2 is connected to microprocessor 61, comprising a keyboard for entering data.

One output of microprocessor 61 is connected through a line section 90 to a control circuit (known per se and therefore not shown) of stepping motor 56. Another output of microprocessor 61 is connected through a line section 91 to a control circuit (known per se, therefore not shown) of a positioning motor 92 which is in drive connection with main shaft 4 of sewing machine 1, through a belt 93.

Two further outputs of microprocessor 61 are connected through two amplifiers (not shown) and two lines 94,95 to switching magnets of two 4/2 directional valves 96,97. Valves 96,97 serve the purpose of supplying air cylinders 19, 20 in a controlled manner, the source of compressed air being indicated at 98.

The sewing machine operates as follows:

First, the sewing of a single-row corner seam 99 will be described, with the workpiece W having a trailing edge K2 extending at right angles to a guiding or leading edge K1. A single-row seam will normally be produced on a single-needle sewing machine. To simplify the description however, be it assumed that the single-row seam is being produced on the above-described 2-needle sewing machine 1. In such a case, microprocessor 61 is instructed, through input unit 89, to switch directional valve 97 from its position shown in FIG. 2 into its other position, so that air cylinder 19 is reversed and lever 16 is pivoted to disengage locking lever 11 through actuating shaft 14. In this way, left-hand needle bar 8 is disengaged from its drive for the entire period during which the seam is produced, and is retained in its upper dead center position.

Microprocessor 61 is further supplied through input unit 89 with data on the stitch length with which seem 99 is to be formed. Microprocessor 61 delivers to stepping motor 56 corresponding instructions for turning setting wheel 49. The rotation of setting wheel 49 is transmitted through swing lever 45, ball-headed rod 44, and setting crank 43 to setting shaft 42. Thereby, the position of link 39 is changed relative to the position of link 36 to the effect that eccentric 33 imparts to feed dog 25 a feed motion corresponding to the desired stitch length. The rotary motion of shaft 42 for setting the stitch length analogously effects a change in the resistance of potentiometer 58 which is connected to shaft 42. This value representing the set stitch length $L_{St}$ is also entered into microprocessor 61.

Finally, the distance a between seam 99 and the edge K1 of workpiece W is stored in microprocessor 61 through input unit 89. With the workpiece having its edges K1, K2 at right angles, seam 99 is to terminate at a corner point E equidistantly spaced from both edges.

Upon entering the needed data, the sewing operation is performed. At the end of the sewing operation, trailing edge K2 first passes beneath the front sensor 78. As soon as sensing spot 80 on reflex foil 65 is exposed, sensor 78 delivers a switching pulse to microprocessor 61. The microprocessor then switches positioning motor 92 to a predetermined low speed at which sewing machine 1 can later be stopped without delay.

Thereupon, trailing edge K2 passes simultaneously beneath sensors 69 and 74. As soon as sensing spots 72 and 76 on reflex foils 64 and 65 are exposed, sensors 69, 74 deliver each a switching pulse to microprocessor 61. Since the two switching pulses are produced simultaneously, microprocessor 61 concludes that trailing edge K2 is perpendicular to leading edge K1. In such an event, the distance of the predetermined corner point E from trailing edge K2 always equals the distance a of the seam from the edge, the switching pulse of sensor 74 does not further affect the following operation of microprocessor 61.

The switching pulse of sensor 69 produces the effect that since that instant, only the pulses produced by pulse generator 83 during the transportation phases are added in a register of microprocessor 61, until trailing edge K2 passes beneath rear sensor 64 and a switching pulse is delivered by this sensor to microprocessor 61 upon exposing sensing spot 68 on reflex foil 65. The thus determined sum of pulses delivered by pulse generator 83 and corresponding to the actual motion of workpiece W is compared with a number of pulses simultaneously computed by microprocessor 61 and obtained by dividing the distance between sensing spots 72 and 68 by a factor permanently stored in microprocessor 61 and depending on the set stitch length $L_{St}$.

Would no slip occur between feed dog 25 and workpiece W during the transportation phases, the sum of pulses by pulse generator 83 would exactly equal the number of pulses computed from the distance between spots 73 and 68 and the stored factor. Usually, however, a slip occurs between feed dog 25 and workpiece W and its magnitude depends on the thickness, elasticity, and surface structure of workpiece W. Due to the slip, a larger number of pulses by pulse generator 83 will be registered within the period between the two switching pulses of sensors 69 and 64, than with a slip-free transportation. The total slip now corresponds to the difference between the sum of registered pulses and the computed number of pulses.

The actual stitch length L of seam 99, which is shorter relative to the set stitch length $L_{St}$ due to the slip, is computed by microprocessor 61 as follows: $L=L_{St}\cdot Z_1/Z_2$, with $Z_1$ being the computed number of pulses, and $Z_2$ being the sum of pulses registered during the time period between the two switching pulses of sensors 69 and 64.

Figure 3:
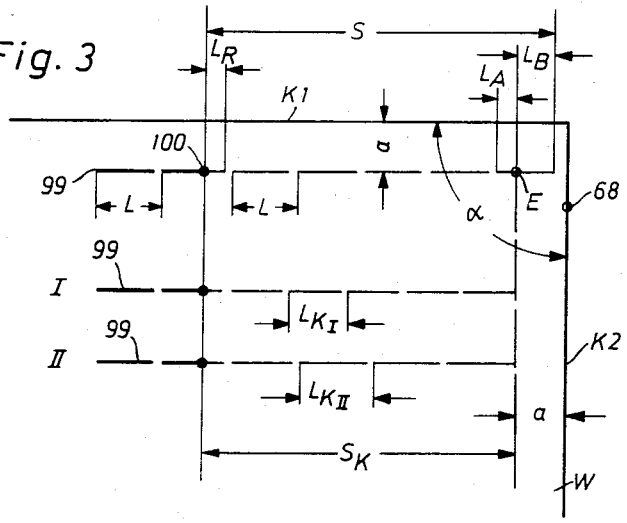
FIG. 3 is a diagrammatical illustration of a corner sewing operation, showing a non-corrected seam, and two examples of corrected seams.

The delivery of the switching pulses by rear sensor 64 starts a computation in microprocessor 61, by means of the previously determined actual stitch length L of how long the residual seam length S after the response of sensor 64 would be if continued with an unchanged setting of setting mechanism 52. Since a time coincidence between the delivery of the switching pulse by the rear sensor 64 and the start of the transportation phase would be a sheer accident, microprocessor 61 determines the residual length $L_R$ of the started stitch by summing the pulses generated by pulse generator 83 since the instant of response of rear sensor 54 up to the termination of the started stitch. The residual length S of the seam is computed as follows: $S=L_R+n\cdot L$ wherein n is the number of complete stitches after the response of rear sensor 64.

in FIG. 3, point 100 indicates the position of needle 24 of the engaged needle bar 9 relative to workpiece W at the instant at which edge K2 is passing through sensing spot 68 of rear sensor 64. In the example shown in FIG. 3, the residual seam length S would extend beyond predetermined corner point E, with $L_A$ being the initial length of the last stitch, and $L_B$ being the length in excess of the last stitch.

Thereupon, microprocessor 61, while taking the account the slip between feed dog 25 and workpiece W, the residual length $L_R$ of the starter stitch, the initial length and the length in excess $L_A$, $L_B$ of the last stitch, and the number n of complete stitches, computes the corrected stitch length $L_K$ at which the sewing operation (seam 99) must be continued after the instant of response of sensor 64, to ensure a termination of the last stitch exactly at the predetermined corner point E.

If the result of the computation shows a small length in excess $L_B$ and a large initial length $L_A$, the length in excess $L_B$ is distributed among the n stitches of the residual seam by reducing the stitch length, the corrected residual seam length $S_{KI}$ being:

$$\begin{aligned} S_{KI} &= S - L_B \\ &= L_R + n \cdot L_{KI} \\ &= L_R + n\left(L - \frac{L_B}{n}\right) \end{aligned}$$

If a large length in excess $L_B$ and a small initial length $L_A$ are found, the initial length $L_A$ of the last stitch is distributed among the other stitches by increasing the stitch length, with the total number of residual stitches being reduced in this case. The corrected residual seam length $S_{KII}$ is then:

$$S_{KII} = S - L + L_A$$

-continued $$= L_R + (n-1)L + L_A$$

$$= L_R + (n-1)L_{KII}$$

$$= L_R + (n-1)\left(L + \frac{L_A}{n-1}\right)$$

Since the microprocessor has a high operating speed, a setting instruction corresponding to the difference between the preset stitch $L_{SI}$ and the computed stitch length $L_K$ is delivered to stepping motor 56 immediately after the response of rear sensor 64, and stepping motor 56 actuates setting mechanism 52 to reset the stitch length.

Since a slip which might have occurred between feed dog 25 and workpiece W has already been taken into account and compensated for in the computation of the corrected stitch length $L_K$, seam 99 terminates exactly at the predetermined corner point E. At the same time, initial length $L_A$ or length in excess $L_B$ of the last stitch of the computed residual seam length are uniformly distributed among a plurality of stitches, so that the resulting corrected stitch length $L_K$ differs only a little from the stitch length L of the other portion of seam 99. In this way, a very uniform aspect of the seam is obtained.

Figure 4:
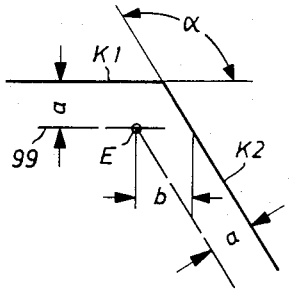
FIG. 4 is a diagrammatical illustration of a corner sewing operation, with the workpiece having edges at an obtuse angle

With an angle $\alpha$ smaller or larger than 90°, the distance b (FIG. 4) of corner point E from trailing edge K2 is given by $b = a/\sin\alpha$, with a again being the distance of the seam from the edge. Angle $\alpha$ corresponds to the sum of pulses by pulse generator 83, registered during the period of time between the responses of the two central sensors 69 and 74. Since the sine of 90° is one, an angle $\alpha = 90°$ has no influence on the computation of the corrected residual seam length $S_K$ or the corrected stitch length $L_K$. An angle $\alpha$ differing from 90°, on the contrary, affects the computation of the corrected residual seam length $S_K$ or the corrected stitch length $L_K$, correspondingly.

With two-row corner seams, the approach to corner point E1 of inner seam 101 (FIG. 5) extending at a distance c from the trailing edge K2 is controlled by microprocessor 61 in the same way as corner point E of the single-row seam 99, by a corresponding correction of the stitch length setting by mechanism 52. Upon terminating the last stitch of inner seam 101 at corner point E1, needle bar 8 is disengaged in its upper dead center position from its drive by an instruction from microprocessor 61 reversing directional valve 97, whereby rocking lever 11 is pivoted into its disengaged position.

After disengaging needle bar 8, outer seam 102 is sewn up to corner point E2, and the stitch length and number of stitches necessary needed for this residual portion d are again computed by microprocessor 61. Upon producing the last stitch of outer seam 102 at corner point E2, sewing machine 1 is stopped with needle bar 9 in its lower dead center position, and workpiece W is then turned about needle 24 until edge K2 extends in the feed direction V.

As soon as workpiece W is turned into its new position, sewing machine 1 is started again and, initially, only the outer seam 103 is sewed with needle bar 9. Upon outer seam 103 being produced in a length corresponding to the residual portion d of seam 102, microprocessor 61 delivers an instruction to the effect that needle bar 8 is reengaged to its drive, and setting mechanism 52 is reset to its initial value. As from this instant, both seams 103 and 104 are sewn with the same stitch lengths as have seams 101 and 102 prior to the start of the correction phase.

While a specific emodiment of the invention has been shown and described in detail to illustrate the application of the principles of the invention, it will be understood that the invention may be embodied otherwise without departing from such principles.

What is claimed is:

1. In a sewing machine having a needle with drive means for driving the needle, feed means for feeding a workpiece having a guiding and a trailing edge extending at an angle relative to each other, a setting device for setting the feed means, and means for producing shaped seams having a first sensor which is positioned ahead of the needle in a feed direction of the workpiece for sensing the trailing edge of the workpiece, a pulse generator coupled to a main shaft of the sewing machine, and a program controlled switching circuit by which the sewing machine is stopped at a predetermined end point in response to pulses issued from the sensor and the pulse generator, the improvement comprising: sensing means for determining an actual feed distance; and setting means associated with the switching circuit and the setting device for controlling the setting device in response to a determined difference amount between a desired and the actual feed distance and an angular position of the main shaft at an instant of response of the first sensor, which angular position corresponds to a displacement of the feed means, said setting means being operable to adjust the setting device to form stitches of various lengths from zero to a maximum stitch length.

2. The improvement of claim 11, wherein said setting means in conjunction with said program controlled switching circuit is operable to distribute said determined difference between a desired and the actual feed distance and an angular position of the main shaft, among a plurality of stitches to be formed after the instant of response of said first sensor.

3. The improvement of claim 1, including second and third sensors spaced apart from each other in a direction transverse to the feed direction of the workpiece and ahead of the first sensor in the feed direction of the workpiece, said second and third sensors connected to the switching circuit for measuring the angle between the guiding edge and trailing edge of the workpiece.

4. The improvement according to claim 2, wherein said second sensor is aligned with the first sensor in the feed direction of the workpiece.

5. The improvement of claim 2, wherein one of said second and third sensors forms a part of said sensing means for measuring the actual feed distance of the workpiece.

6. The improvement of claim 3, wherein said one of said second and third sensors which is aligned with the first sensor in the feed direction of the workpiece forms a part of said sensing means for measuring the actual feed distance of the workpiece.

7. The improvement according to claim 1, including a fourth sensor for sensing the trailing edge of the workpiece provided ahead of said sensing means in the feed direction of the workpiece, said fourth sensor connected to said switching circuit, means for reducing a speed of operation of the sewing machine to a low speed, said fourth sensor operable to release said means for reducing to cause the speed of the sewing machine to be reduced to low speed which remains constant during a period of time when the actual feed distance is being measured.

8. A device for producing shaped seams in a sewing machine having a main shaft, at least one needle engaged with the main shaft for forming stitches, workpiece feed means for feeding the workpiece in a feed direction passed the needle, and stitch length setting means for setting the length of each stitch, the device comprising:

a control switching circuit;

a pulse generator operatively coupled to the main shaft for generating pulses during the movement of the workpiece by the feed means;

a first sensor positioned ahead of the needle in the workpiece feed direction for sensing the passage of a trailing edge of the workpiece, the workpiece having a guiding edge extending at an angle to the trailing edge thereof;

a second sensor for sensing the passage of the trailing edge aligned with said first sensor in the feed direction of the workpiece; and a third sensor spaced laterally of said second sensor in the feed direction of the workpiece, said second and third sensors connected to said controlled switching circuit for supplying respective signals with the passage of the trailing edge of the workpiece to the controlled switching circuit which, with pulses from said pulse generator, is operable to calculate the angle between the trailing and guiding edges of the workpiece;

said controlled switching circuit being connected to said first sensor and operative with pulses from said pulse generator and a signal from said second sensor to determine an actual feed distance for the workpiece along the feed direction thereof, and to compare the actual feed distance with a desired feed distance.

9. A device according to claim 7, including a fourth sensor positioned ahead of said second sensor in an alignment with said first and second sensors in the feed direction of the workpiece, connected to said control switching circuit for sensing the passage of the trailing edge, and speed reduction means connected to said sewing machine and to said controlled switching circuit for reducing the speed of said sewing machine with the sensing by said fourth sensor of the passage of the trailing edge.

10. A device according to claim 8, wherein said sewing machine includes two needles each operatively engaged with said main shaft and needle selection means associated with said needles for selectively engaging and disengaging each of said needles to and from the main shaft, said needle selection means connected to said controlled switching circuit.

11. A device according to claim 7, wherein said switch length setting means comprises a stepping motor connected to said controlled switching circuit, a worm connected to and rotatable by said stepping motor and a stitch length selecting wheel engaged with said worm and operatively connected to said workpiece feed means for adjusting the length of stitches formed by the sewing machine.

* * * * *